US005135132A

United States Patent [19]

Potochnik

[11] Patent Number: 5,135,132

[45] Date of Patent: Aug. 4, 1992

[54] COLLAPSIBLE INFLATABLE BEVERAGE CONTAINER

[76] Inventor: Robert J. Potochnik, P.O. Box 4497, Boca Raton, Fla. 33429

[21] Appl. No.: 625,429

[22] Filed: Dec. 3, 1990

[51] Int. Cl.[5] ..... B65D 30/10

[52] U.S. Cl. ..... 220/426; 220/635; 220/642; 220/907; 383/3

[58] Field of Search ..... 383/3, 121.1; 220/426, 220/907, 906, 904, 642, 640, 635

[56] References Cited

U.S. PATENT DOCUMENTS

| | | | |
|---|---|---|---|
| 1,368,158 | 2/1921 | Jones | 220/635 |
| 1,406,744 | 2/1922 | McCarren | 220/635 |
| 1,965,028 | 7/1934 | Bissell | 220/426 |
| 2,505,845 | 5/1950 | Alvarez | 383/3 |
| 3,058,507 | 10/1962 | Patterson | 383/121.1 |
| 3,742,994 | 7/1973 | Pensak | 383/3 |
| 4,089,358 | 5/1978 | Korson | 383/3 |
| 4,357,809 | 11/1982 | Held et al. | 220/426 |
| 4,623,064 | 11/1986 | Ruda | 383/3 |
| 4,705,085 | 11/1987 | Brown | 383/3 |
| 4,826,329 | 5/1989 | Bellini | 383/3 |

*Primary Examiner*—Stephen Marcus
*Assistant Examiner*—S. Castellano
*Attorney, Agent, or Firm*—Malin, Haley, McHale, DiMaggio & Crosby

[57] ABSTRACT

An inflatable beverage container defined by concentric inner and outer cylindrical walls which further define an annular chamber therebetween, the cylindrical walls terminating in a semi-rigid inverted "V shaped" upper lip which defines a top end of the container, and a planar base which circumferentially defines the bottom end of the container, the container further having an inflatable handle in fluidic communication with the annular chamber, the container additionally having an integral apparatus for introducing air into the annular chamber for inflation or deflation thereof for easy storage.

7 Claims, 4 Drawing Sheets

COLLAPSIBLE INFLATABLE BEVERAGE CONTAINER

BACKGROUND OF THE INVENTION

1. Field of the Invention

The invention relates to a container for holding liquids and more particularly to a beverage container whose side walls are hollow and inflatable by air so as to provide rigid walls.

2. Description of Related Art

It has long been recognized that when flexible, airtight material is sealed to form an inner chamber, and the inner chamber is filled with air, the flexible material defining the chamber becomes rigid. This principle is exemplified in the ordinary automobile or bicycle tire which becomes more rigid as air is pumped into the inner chamber defined by the flexible material of an inner tube or the tire itself.

Another example of using air under pressure within a chamber to define the shape of the object is the common inflatable children's swimming pool as shown, for example, in U.S. Pat. No. 2,443,440, issued on Jun. 15, 1948 to O. J. Alvarez.

In addition, this inflation principle has been incorporated into inflatable carrying bags such as that disclosed in U.S. Pat. No. 4,164,970, issued to Charles Jordon on Aug. 21, 1979, and in U.S. Pat. No. 4,503,558, issued to Joseph Lief and Michael McCully on Mar. 5, 1985.

Further, inflatable containers for storing trash are disclosed in U.S. Pat. No. 3,556,186, issued to Gerard Besthorne on Jan. 19, 1971, and in U.S. Pat. No. 3,742,994, issued to Philip Pensak on Jul. 3, 1973.

An inflatable container for storing food is disclosed in U.S. Pat. No. 4,085,785, issued Apr. 25, 1978 to Eric Hoot.

Finally, a collapsible container for holding liquids which has inflatable walls is disclosed in U.S. Pat. No. 2,751,953 issued to B. F. Grimm on Jun. 26, 1956. The Grimm container has side walls which are pleated as in the side walls of an accordion. In addition, the "cup" part of the container may be sealed to prevent air within the cup from escaping to the outside. The Grimm container has a series of valves and plugs to allow air to enter the inner chamber formed between the walls of the container when the pleated walls of the container are collapsed and the "cup" sealed so that air may not escape to the outside. The collapsing of the pleated walls of the container forces air within the cup into the inner chamber between the walls under pressure thereby inflating the inner chamber. After the inner chamber has been inflated in this manner and sealed, the "cup" is unsealed so that liquid may be dispensed into or out of the cup of the container.

SUMMARY OF THE INVENTION

A mug of ordinary size and use is provided which is collapsible so as to be easily transported. The mug moves from its collapsed configuration to its usable configuration by inflating an inner chamber formed between an exterior and interior side wall. This inner chamber is inflated with air placed into the interior chamber under pressure through a valve. The air under pressure causes the mug to attain a normal mug shape and to become rigid. At the same time, the air within the inner chamber provides insulation for the liquid contained within the mug It is therefore an object of the instant invention to provide a collapsible mug.

It is a further object of the invention to provide an inflatable mug, which in addition to rendering itself collapsible, also provides insulation for a liquid stored or contained within it.

It is a further object of the invention to provide a collapsible mug which is rigid in use.

It is a further object of the instant invention to provide a collapsible mug which is easy to manufacture.

It is a still further object of the instant invention to provide a collapsible mug which is easy to use.

These and other objects of the instant invention will become clear from the following detailed description with reference to the drawings where like elements are referred to by like numerals.

DETAILED DESCRIPTION OF THE INVENTION

Figure 1:
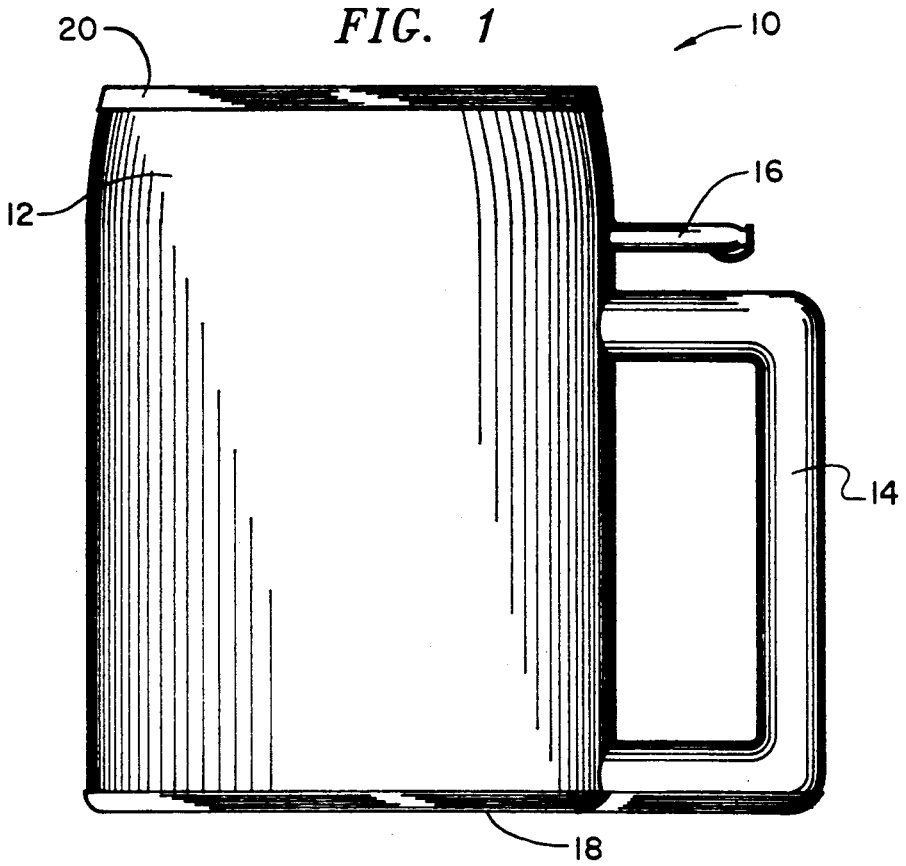
FIG. 1 is a left side elevational view of the invention.
Figure 2:
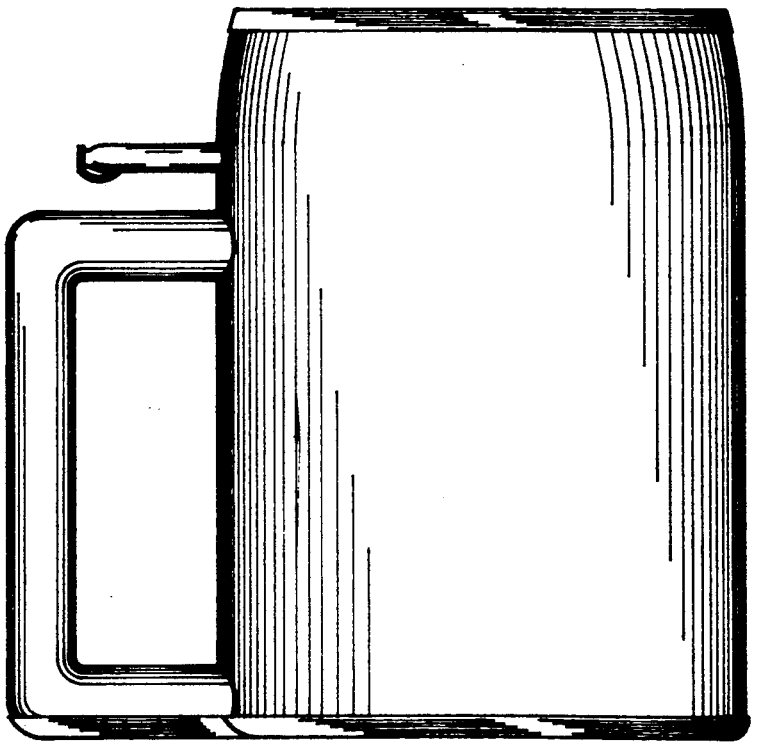
FIG. 2 is a right side elevational view of the device of FIG. 1.

Referring to FIG. 1, the mug is shown generally labeled 10, and comprises a cup 12, handle 14, valve 16, base 18 and lip 20.

Figure 3:
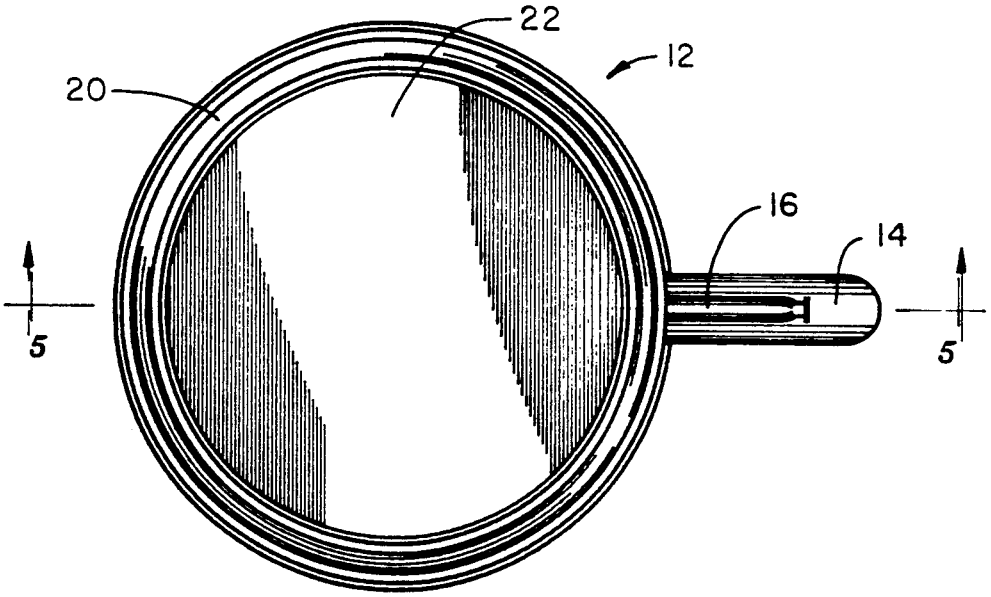
FIG. 3 is a top plan view of the invention.
Figure 4:
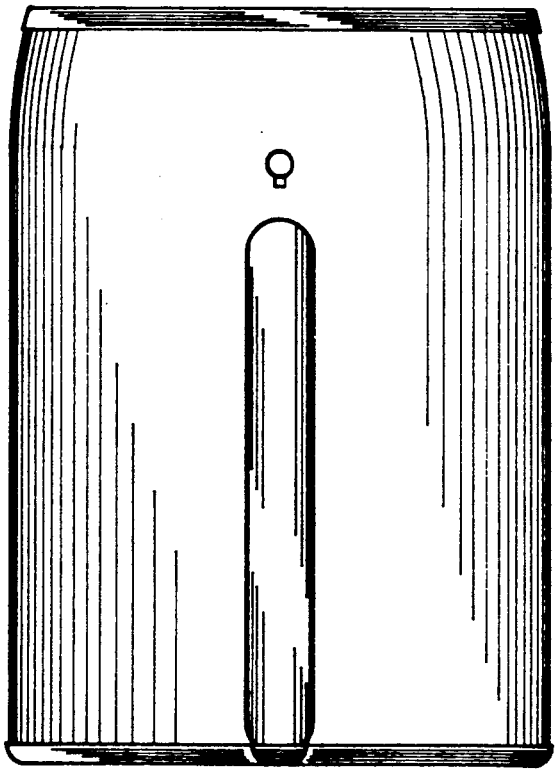
FIG. 4 is a side elevational view of the invention along the handle and inflation valve.
Figure 8:
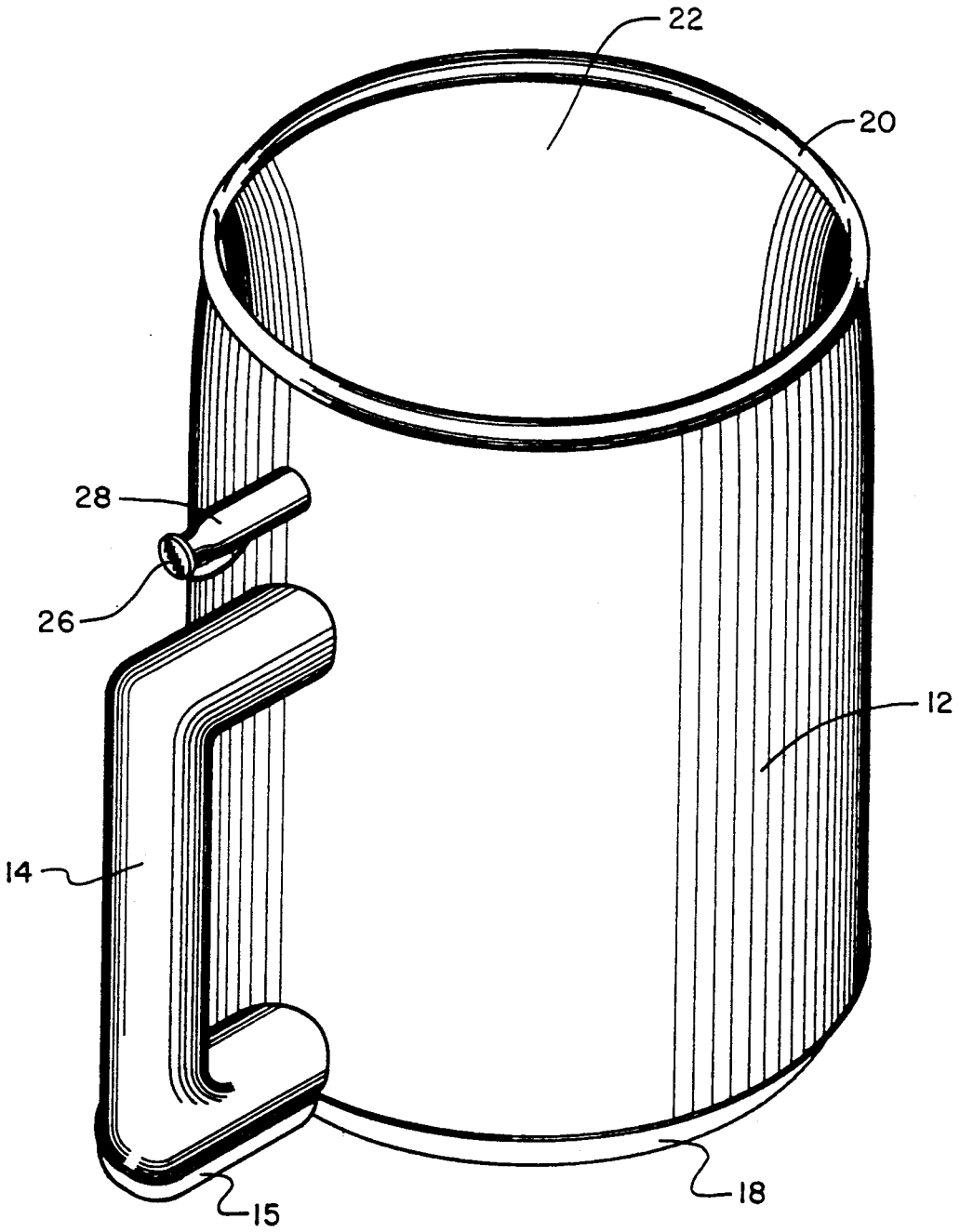
FIG. 8 is a perspective view of the invention.

As can be seen from FIGS. 3 and 8, the cup 12 is cylindrical with an opening into the beverage chamber 22 through lip 20. From FIG. 5, it is seen that beverage chamber 22 is defined by an inner side wall 34 and base plate 39, which is part of base 18, at the bottom.

Separating inner side wall 34 and outer side wall 35 is side wall chamber 24. Inner and outer side walls 34 and 35 respectively are made of a flexible airtight material. Side wall chamber 24 extends cylindrically entirely around beverage chamber 22.

Figure 5:
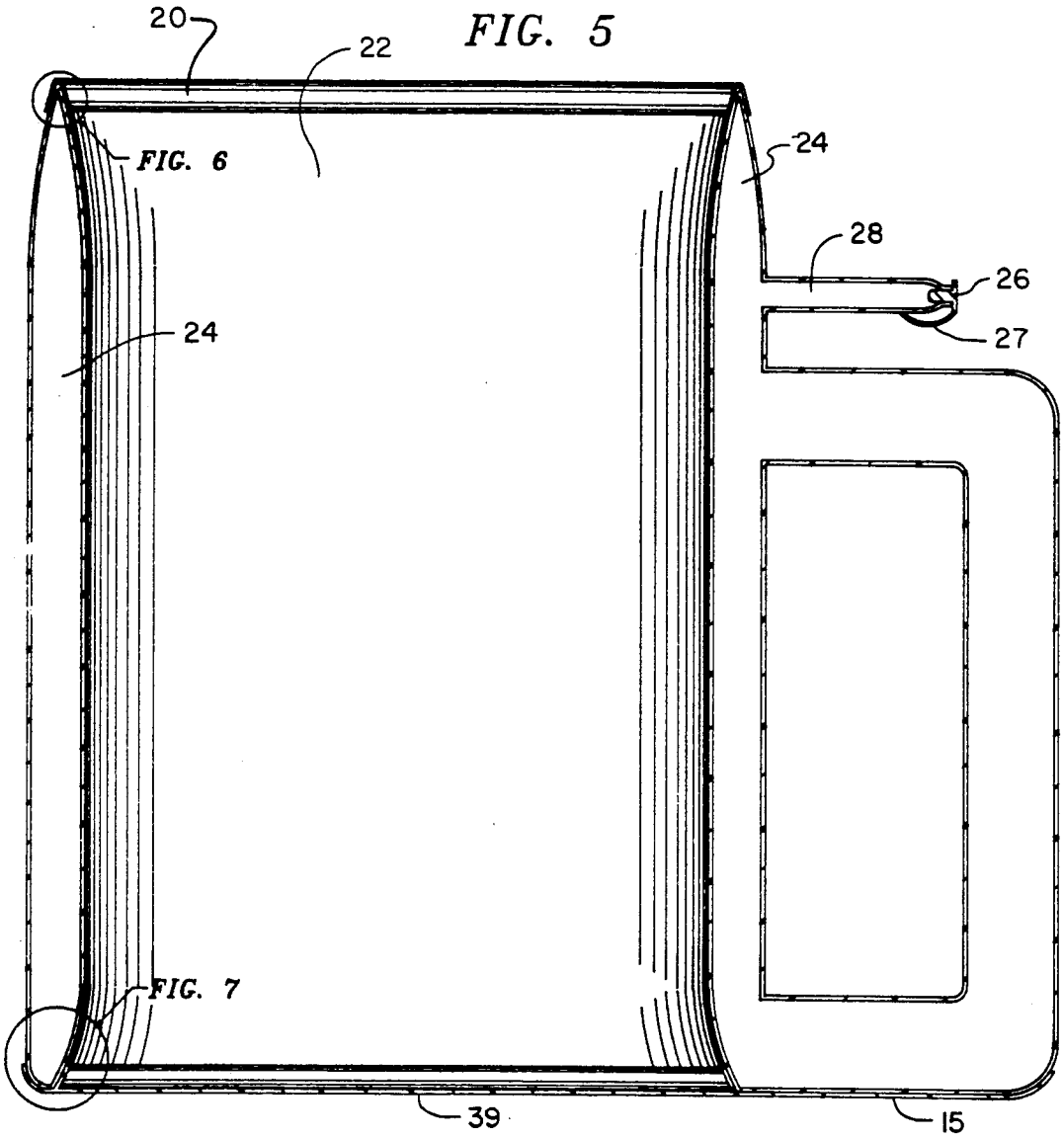
FIG. 5 is a cross sectional view of the invention shown in FIG. 1.

Handle 14, extends outward and away from side wall chamber 24. As can be seen in FIG. 5, handle 14 is also comprised of flexible, airtight material which defines a hollow chamber.

Valve tube 28 extends away from side wall chamber 24 and ends in plug 26 attached to valve tube 28 by a connector 27. When plug 26 is removed from valve tube 18, air may be blown into side wall chamber 24 thereby inflating side wall chamber 24 and handle 14. After a sufficient amount of air has been blown into side wall chamber 24, valve tube 18 may be pinched between the fingers of the user thereby preventing the release of air from side wall chamber 24. Thereafter, plug 26 may be inserted into valve tube 18 thereby sealing air under pressure within side wall chamber 24 and handle 14.

Figure 6:
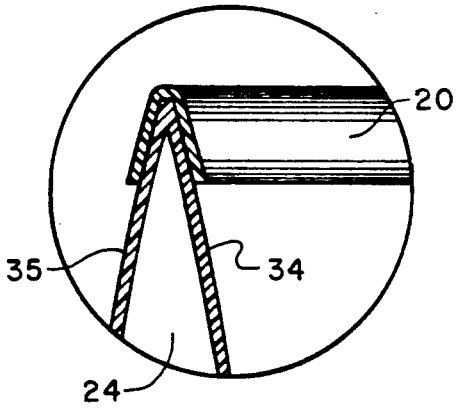
FIG. 6 is a close-up of the area labeled "FIG. 6" in FIG. 5.
Figure 7:
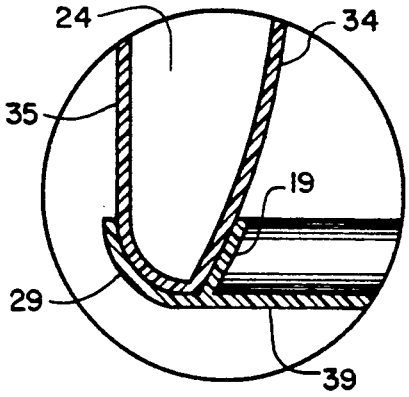
FIG. 7 is a close-up of the area labeled "FIG. 7" in FIG. 5.

Lip 20 extends around the top of side wall chamber 24. As shown in FIG. 6, lip 20 is preferably made of a semi-rigid plastic material in an inverted "V"-shape to clearly define the top of beverage chamber 22 and to provide a comfortable contact with a mouth when drinking from mug 10. Lip 20 is attached to the top of inner and outer side walls 34 and 35 respectively by glue or other similar means.

Base 18 extends across the bottom of cup 12, and comprises a base plate 39 which extends entirely across the bottom of cup 12. Around the edges of base 18 is an inner flange 19 and an outer flange 29 which together form a cradle for the bottom of the inner and outer side walls 34 and 35 respectively at the base of side wall chamber 24. Base 18 is also preferably made of a semi-rigid plastic material to clearly define the shape of the bottom of cup 12. Inner and outer side walls 34 and 35 respectively are attached to inner and outer flanges 19 and 29 respectively by glue or other similar means so that side wall chamber 24 is securely positioned between the separation of inner and outer flanges 19 and 29 respectively.

When it is desired to store mug 10, plug 26 is removed from valve tube 28 thereby releasing air from side wall chamber 24 and handle 14. Thereafter, lip 20 may be brought near base 18 accelerating the release of air from side wall chamber 24 and handle 14. As lip 20 is brought near base 18, the space taken up by mug 10 decreases thereby allowing mug 10 to be conveniently stored in a limited space such as a pocket.

Air within side wall chamber 24 not only provides the means for imparting rigidity to inner and outer side walls 34 and 35 respectively and handle 14, but it also provides insulation of the beverage stored within beverage chamber 22. This insulation not only prevents heated liquids from rapidly losing their heat through the side walls 34 and 35 respectively, but also protects the hand of the user of the mug should the user decide to grasp the cup 12 around outer side wall 35 in the alternative or in addition to grasping handle 14. Further, cool beverages within beverage chamber 22 are insulated by the insulating air within side wall chamber 24 from being heated from heat passing from outside mug 10 through the side walls 34 and 35 respectively.

In the preferred embodiment, the handle 14 contains a handle base 15 which extends away from base plate 39 so as to provide additional stability to mug 10 as it is placed on base plate 39. Handle base 15, like base 39, is preferably made of a semi-rigid plastic material to define the shape of handle base 15. In an alternate embodiment, the handle base 15 may be raised a distance above base plate 39 to define a handle such as is common for ordinary mugs.

Although the preferred embodiment of the mug includes a handle 14, an alternate embodiment could forego handle 14. In this embodiment, side wall chamber 24 extends continuously around the periphery of cup 12 without a protrusion for grasping the mug 10. In this embodiment, outer side wall 35 may have ribbings or the like directed outwardly to assist in grasping mug 10. Of course, valve tube 28 would still protrude outward from the outer side wall 35 as in the preferred embodiment.

The instant invention has been described in connection with a specific embodiment. It is to be understood that the description contained herein is given by means of example only and not for limitation. Changes and modifications may be made to the description given and still be within the scope of the invention as claimed. Further, obvious changes and modifications will occur to one skilled in the art.

What I claim is:

1. An inflatable beverage container comprising:

(a) a cup defined by a generally cylindrical side wall chamber having an inner side wall disposed to the interior of said cup and an outer side wall disposed outwardly from said cup, said inner and said outer side walls being flexible and of an air impervious material;

(b) a base extending entirely across the bottom end of said cup, said base attached to said side wall chamber around the circumference of said side wall chamber;

(c) means for inserting releasing air into said side wall chamber comprising a tube having a first and second end, said first end of said tube connected to said outer side wall, said tube having a plug insertable into said second end of said tube, whereby air within said side wall chamber is restrained from leaving said side wall chamber through said tube by said plug;

(d) means for aiding in grasping said beverage container; and (e) a lip extending around the upper circumference of said side wall chamber, said lip comprising a semi-rigid material which defines the upper shape of said side wall chamber, said lip further comprising a substantially inverted "V shaped" piece, wherein said inner and outer side walls of said side wall chamber are disposed between the insides of said inverted "V shaped" piece, whereby, when said plug is removed from said tube, air within said side wall chamber may be expelled through said tube as said inner and outer side walls are collapsed and, when said plug is removed from said tube, air under pressure may be introduced into said side wall chamber through said tube, thereby inflating said side wall chamber and thereby defining the shape of said beverage container, said plug thereafter being inserted into said second end of said tube to prevent air within said side wall chamber from escaping.

2. The beverage container of claim 1 wherein said base is attached to said side wall chamber around the circumference of said side wall chamber at substantially a right angle to said side wall chamber.

3. The beverage container of claim 1, wherein said means for aiding in grasping said beverage container comprises a handle extending away from said side wall chamber.

4. The beverage container of claim 3, wherein said handle is hollow and attached to said side wall chamber so that air present within said side wall chamber may pass into said hollow handle thereby inflating said handle.

5. The beverage container of claim 1, wherein said base comprises a semi-rigid disc.

6. The beverage container of claim 5, wherein said disc further comprises an inner flange and an outer flange, said inner and outer flange located around the circumference of said base, said inner and outer flange extending upward from said base and away from each other to form an upwardly directed cradle, said cradle for receiving the lower edges of said inner and outer side walls of said side wall chamber.

7. An inflatable beverage container comprising:

a) a cup defined by a generally cylindrical side wall chamber having an inner side wall disposed to the interior of said cup and an outer side wall disposed outwardly from said cup, said inner and said outer side walls being flexible and of an air impervious material;

b) a base extending entirely across the bottom end of said cup, said base attached to said side wall chamber around the circumference of said side wall chamber at substantially a right angle to said side wall chamber at the bottom of said side wall chamber, said base comprising a semi-rigid disc, said disc including an inner flange and an outer flange, said inner and outer flange located around the circumference of said base, said inner and outer flange extending upward from said base and away from each other to form an upwardly directed cradle, said cradle for receiving the lower edges of said inner and outer side walls of said side wall chamber;

c) means for inserting and releasing air into said side wall chamber comprising a tube having a first and a second end, said first end of said tube connected to said outer side wall, said tube having a plug insertable into said second end of said tube whereby air within said side wall chamber is restrained from leaving said side wall chamber through said tube by said plug;

d) means for aiding in grasping said beverage container comprising a handle extending away from said side wall chamber, said handle being hollow and attached to said side wall chamber so that air present within said side wall chamber may pass into said hollow handle thereby inflating said handle; and e) a substantially inverted "V"-shaped lip extending around the upper circumference of said side wall chamber, said lip comprised of a semi-rigid material to define the upper shape of said side wall chamber, wherein said inner and outer side walls of said side wall chamber are disposed between the insides of aid inverted "V-shaped" lip;

whereby, when said plug is removed from said tube, air within said side wall chamber may be expelled through said tube as said inner and outer side walls are collapsed, and, when said plug is removed from said tube, air under pressure may be introduced into said side wall chamber through said tube thereby inflating said side wall chamber and thereby defining the shape of said beverage container, said plug thereafter being inserted into said second end of said tue to prevent air within said side wall chamber from escaping.

* * * * *